US008480412B2

(12) United States Patent
Belanger, Jr. et al.

(10) Patent No.: US 8,480,412 B2
(45) Date of Patent: Jul. 9, 2013

(54) TERMINAL AND CONNECTOR ASSEMBLY

(75) Inventors: Thomas D. Belanger, Jr., New Hudson, MI (US); Bert William Eakins, Ortonville, MI (US); George E. Fox, Maybee, MI (US); Michael James Porter, Traverse City, MI (US)

(73) Assignee: Lear Corporation, Southfield, MI (US)

( * ) Notice: Subject to any disclaimer, the term of this patent is extended or adjusted under 35 U.S.C. 154(b) by 128 days.

(21) Appl. No.: 13/165,399

(22) Filed: Jun. 21, 2011

(65) Prior Publication Data

US 2012/0329297 A1 Dec. 27, 2012

(51) Int. Cl.
*H01R 12/00* (2006.01)

(52) U.S. Cl.
USPC ..... 439/84; 439/751

(58) Field of Classification Search
USPC ..... 439/82–84, 571, 751
See application file for complete search history.

(56) References Cited

U.S. PATENT DOCUMENTS 3,846,741 A * 11/1974 Kunkle et al. ..... 439/82
5,556,308 A * 9/1996 Brown et al. ..... 439/746
6,062,916 A * 5/2000 Gladd et al. ..... 439/751
7,044,807 B2 * 5/2006 Furuno et al. ..... 439/751
7,575,488 B2 * 8/2009 Lee et al. ..... 439/876
2001/0014548 A1 8/2001 Matsukawa
2006/0166479 A1 7/2006 Seo et al.
2007/0111612 A1 5/2007 Fabian et al.
2008/0160844 A1 7/2008 Chiang
2008/0318453 A1 12/2008 Dancison
2010/0003868 A1 1/2010 Wu
2010/0035488 A1 2/2010 Zhang

* cited by examiner

*Primary Examiner* — Hien Vu
(74) *Attorney, Agent, or Firm* — Brooks Kushman P.C.

(57) ABSTRACT

A connector assembly is provided with a body that extends along a lateral length with a longitudinal height defined by a first body surface and an opposing second body surface. A locking terminal extends through the body and includes an elongate blade having a distal end for electrically connecting to a mating connector and a proximal end adapted to electrically connect to an electronic component with an aperture. At least one tab extends lengthwise from an intermediate portion of the blade and extends through the electronic component aperture. A projection extends outward from the tab such that the projection interferes with the aperture during insertion of the tab therethrough for deforming the tab. After insertion, the tab returns from the deformation and engages the projection to the electronic component for retaining the tab within the aperture.

19 Claims, 4 Drawing Sheets

TERMINAL AND CONNECTOR ASSEMBLY

TECHNICAL FIELD

One or more embodiments relate to a locking terminal for connecting to a circuit board, a connector assembly for supporting a locking terminal, and a method for connecting a connector assembly to a circuit board.

BACKGROUND

One example of a compliant pin is disclosed in U.S. Patent Application Publication Number 2008/0318453 to Dancison.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
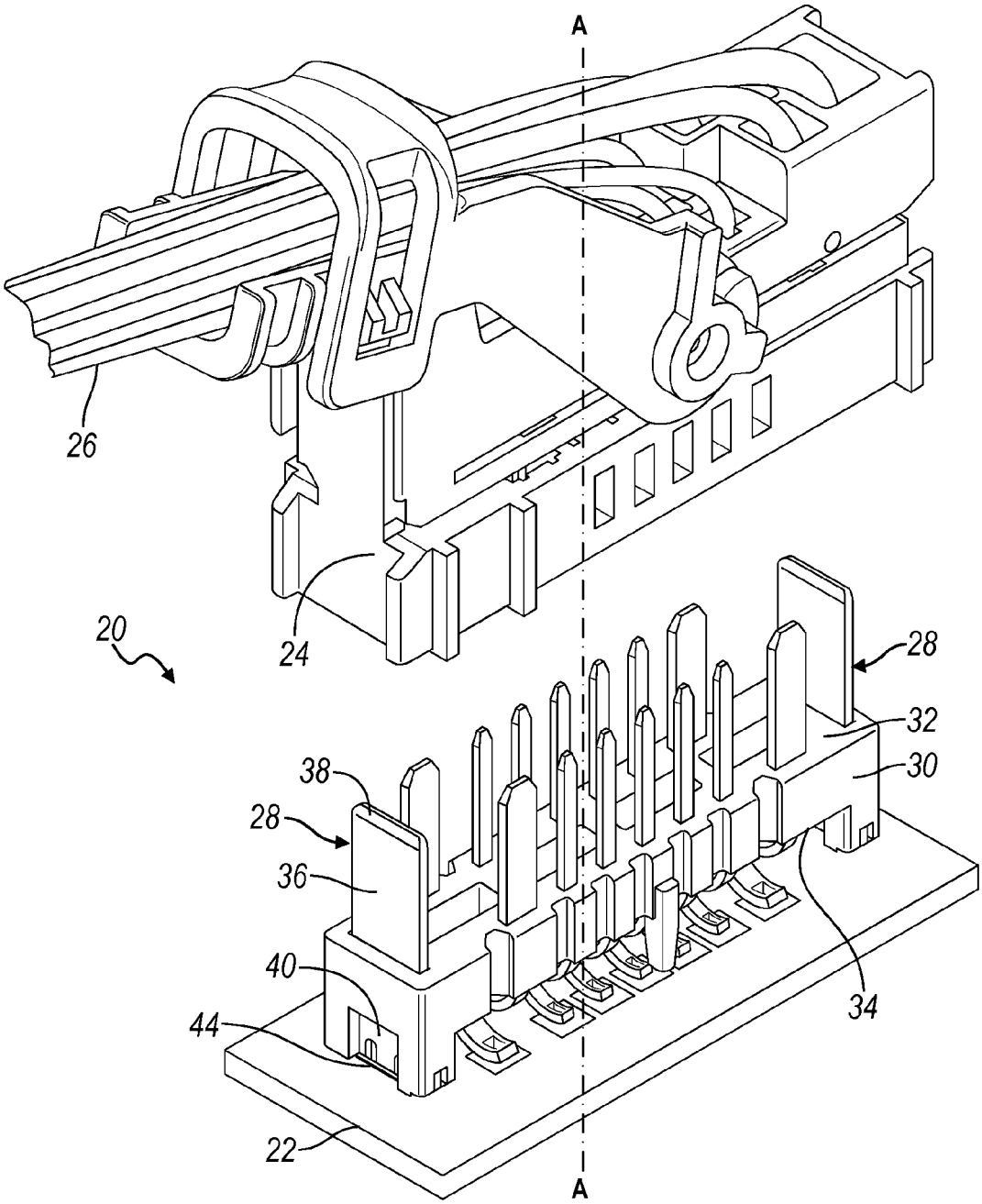
FIG. 1 is a top perspective view of a connector assembly according to at least one embodiment, illustrated with an in-line connector and a circuit board.

With reference to FIG. 1, a connector assembly is illustrated in accordance with an embodiment and is generally referenced by numeral 20. The connector assembly 20 is mounted to a circuit board 22. The connector assembly 20 receives a mating in-line connector 24 along a longitudinal line of insertion A-A. A wire harness 26 extends from the in-line connector 24. The connector assembly 20 includes locking terminals 28 that mechanically connect the connector assembly 20 to the circuit board 22, without applying any residual transverse loads to the board 22 after insertion.

The connector assembly 20 includes a body 30 for supporting the locking terminals 28. The body 30 has a generally rectangular shape and extends along a lateral length. The body 30 includes a first body surface 32 and a second body surface 34 that are longitudinally spaced apart from each other. The body 30 is formed of an electrically insulating polymeric material.

The locking terminals 28 electrically connect the in-line connector 24 to the circuit board 22. Each locking terminal 28 includes a blade 36 with a distal end 38 and proximal end 40. The distal end 38 extends from the first body surface 32 and electrically connects to the in-line connector 24. The illustrated embodiment depicts the distal end 38 formed as a male terminal for engaging a female terminal (not shown), that is retained within the in-line connector 24.

Figure 2:
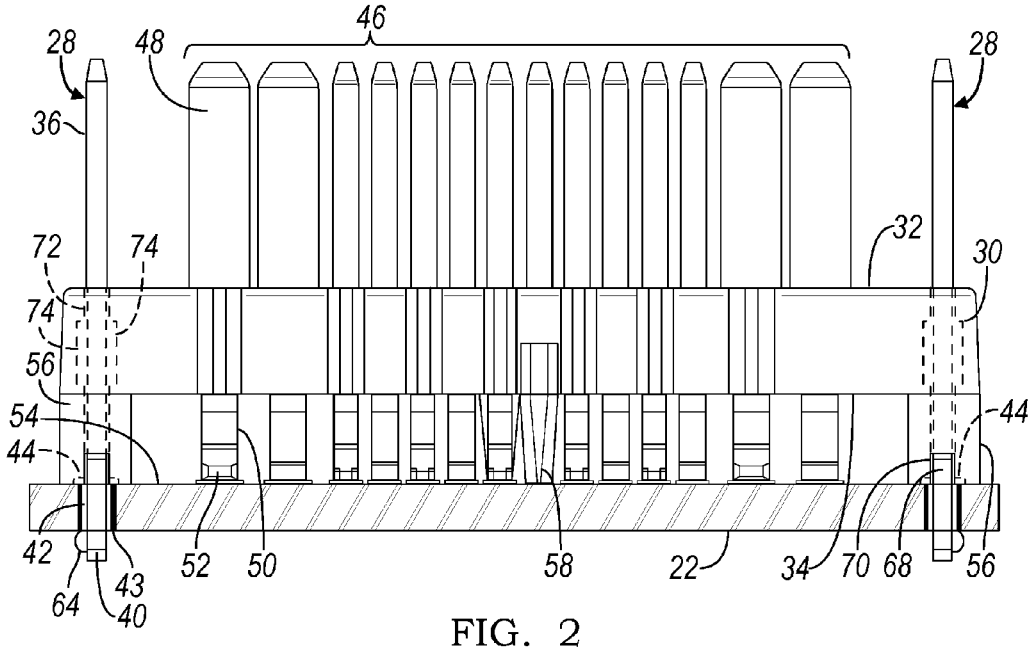
FIG. 2 is a front view of the connector assembly of FIG. 1.
Figure 3:
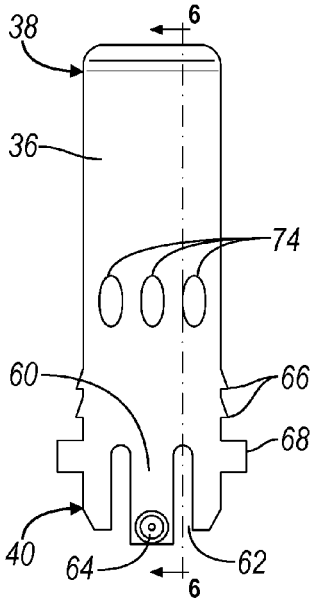
FIG. 3 is a side view of a terminal of the electrical connector assembly of FIG. 1.
Figure 4:
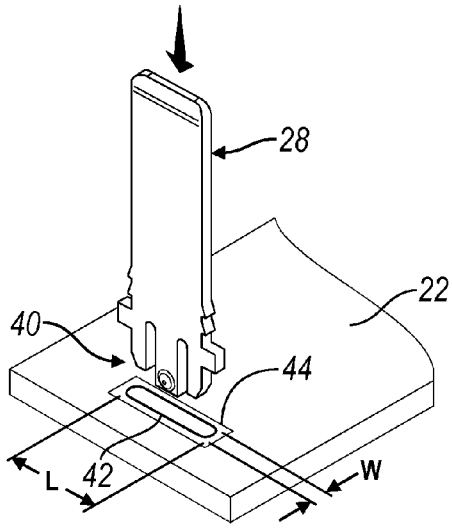
FIG. 4 is a schematic perspective view of the terminal of FIG. 3, illustrated above the circuit board.
Figure 5:
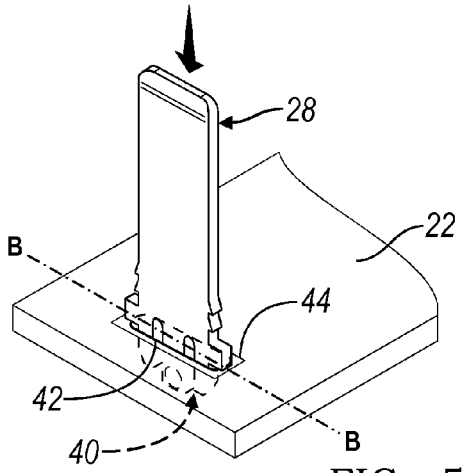
FIG. 5 is another schematic perspective view of the terminal of FIG. 3, illustrated partially extending through the circuit board.
Figure 6:
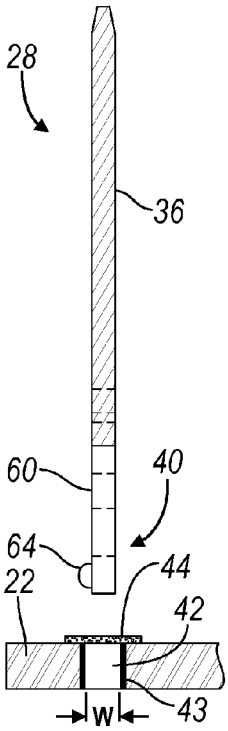
FIG. 6 is a section view of the terminal of FIG. 3, taken along line 6-6, and illustrated above the circuit board.

Referring to FIGS. 2 and 3, the proximal end 40 of each locking terminal 28 electrically connects to the circuit board 22. The proximal end 40 extends from the second body surface 34 and through an aperture 42 formed in the circuit board 22. The circuit board includes a via 43 formed about the aperture 42. The via 43 is a plated through-hole which provides a vertical electrical connection between different layers of conductors (not shown) within the circuit board 22. In one embodiment, the proximal end 40 is soldered to the via 43 using a reflow soldering process. Reflow soldering is a process known in the art, which includes applying an adhesive paste 44 containing powdered solder and flux to a portion of the circuit board 22 about the aperture 42. After the proximal end 40 is inserted through the circuit board aperture 42, the terminal 28 and the circuit board 22 are heated until the paste 44 becomes a liquid and flows into the aperture 42. An infrared lamp, a soldering iron, or a hot air pencil may be used to heat the proximal end 40 of the terminals 28. The liquid solder cools to form an electrical connection or solder joint 45 between each proximal end 40 and corresponding via 43 of the circuit board 22 (shown in FIGS. 8 and 11).

The connector assembly 20 includes a series of surface mount terminals 46 that also electrically connect the in-line connector 24 to the circuit board 22. The surface mount terminals 46 extend through the body 30. Each surface mount terminal 46 includes a blade with a first end 48 and a leg 50 formed at opposite ends of the blade. The first end 48 extends from the first body surface 32 for electrically connecting with the in-line connector 24. The illustrated embodiment depicts the first end 48 formed as a male terminal for engaging a female terminal (not shown) that is retained within the in-line connector 24 (shown in FIG. 1).

The leg 50 of each surface mount terminal 46 electrically connects to the circuit board 22. Each leg 50 extends from the second body surface 34. A foot 52 formed at an end of the leg 50 for contacting a mounting surface 54 of the circuit board 22. A series of contacts (not shown) are formed on the mounting surface 54 for engaging the feet 52. The feet 52 are then soldered to the contacts of the circuit board 22.

The connector assembly 20 includes locking terminals 28 and surface mount terminals 46 of varying size (cross sectional area). The size of a terminal 28, 46 may be selected based on the amount of current passing through an electrical circuit. For example, the connector assembly 20 of the illustrated embodiment includes a surface mount terminal 46 having a width of 2.8 mm, and rated for a maximum current of twenty-three Amps. Locking terminals 28 may be used for electrical circuits carrying high current values, because it may be difficult, or time-consuming to solder large terminals to the circuit board 22. For example, in the illustrated embodiment the locking terminals 28, each have a width of 6.3 mm, and are rated for a maximum current of forty Amps.

The connector assembly 20 includes supports 56 for resting upon the circuit board 22. The supports 56 extend from the second body surface 34 at the lateral ends of the body 30. The locking terminals 28 extend through the supports 56. The connector assembly 20 also includes posts 58 extending from an intermediate portion of the body 30 for resting upon the circuit board 22. The supports 56 and posts 58 support the connector assembly 20 and limit any longitudinal loads from being transmitted to the electrical connections between the terminals 28, 46 and the circuit board 22.

The locking terminals 28 mechanically connect the connector assembly 20 to the circuit board 22. Each locking terminal 28 includes a tab 60 that extends lengthwise towards the proximal end 40 of the blade 36. The tab 60 is formed between a pair of slots 62 that project through the blade 36. The slots 62 are spaced apart from each other along a transverse width of the blade 36 and extend lengthwise from the proximal end 40 to an intermediate portion of the blade 36. A projection 64 extends outward from the tab 60. In the illustrated embodiment the projection 64 is formed in a hemispherical shape. The projection 64 is sized to interfere with via 43 about the circuit board aperture 42 during insertion of the tab 60. After insertion, the projection 64 engages an underside of the circuit board 22 for retaining the tab 60 within the aperture 42, and mechanically connecting the connector assembly 20 to the circuit board 22.

The projections 64 maintain a longitudinal position of the connector assembly 20 relative to the circuit board 22, according to one embodiment. Any gap between the feet 52 of the terminals 46 and the mounting surface 54 of the circuit board 22 may result in a poor electrical connection (solder joint). To avoid such a poor electrical connection, the feet 52 of the surface mount terminals 46 are biased to extend beyond the post 58. The surface mount terminals 46 are formed of a semi-elastic conductive material, such as copper alloy. The legs 50 of the surface mount terminals 46 extend inward between the body 30 and the circuit board 22 to optimize packaging on the board 22 and to allow each leg 50 to elastically deform in a longitudinal direction. The feet 52 are longitudinally spaced apart from the projection 64 of the locking terminal 28 at a distance that is less than the thickness of the circuit board 22. This spacing results in an interference fit between each foot 52 and the mounting surface 54. The projection 64 engages an underside of the circuit board 22 after insertion of the tab 60 for maintaining the longitudinal position of the terminals 28, 46 relative to the circuit board 22, to assist in soldering the feet 52 to the mounting surface 54 of the board 22. Other embodiments of the system contemplate applying a load to the connector assembly 20 in the direction of the circuit board 22 during soldering to ensure proper contact between the feet 52 and the mounting surface 54.

The connector assembly 20 includes features for retaining the locking terminal 28 within the body 30, according to one embodiment. The terminal 28 is inserted into the body 30 during assembly. The terminal 28 includes barbs 66 that extend from an intermediate portion of the blade 36. The barbs 66 engage features (not shown) within the body 30 for retaining the terminal 28. The terminal 28 also includes a terminal stop 68 for limiting an insertion depth of the terminal 28 into the body 30. The body 30 includes a transverse slot 70 formed into each support 56 that receives the terminal stop 68. The terminal stop 68 is not provided for supporting the locking terminal 28 on the circuit board 22, as illustrated by a gap between the terminal stop 68 and the mounting surface 54 of the circuit board 22 in FIG. 2. Other embodiments of the connector assembly 20 contemplate molding the body 30 over the terminals 28, which may eliminate the barbs 66 and the stop 68.

The connector assembly 20 also includes features for maintaining a perpendicular orientation of the locking terminal 28 relative to the body 30, according to one embodiment. The body 30 includes a terminal cavity 72 for receiving each locking terminal 28. The lateral width of the cavity 72 is larger than the thickness of the blade 36 to allow the terminal 28 to be inserted into the body 30. The difference between these two dimensions results in a perpendicularity tolerance of the distal end 38 of the terminal 28 relative to the body 30, which may result in misalignment between the connector assembly 20 and the in-line connector 24 or the board 22. The terminal 28 includes darts 74 extending from an intermediate portion of the blade 36 to control the perpendicularity of the distal end 38. The darts 74 include at least two darts 74 extending in opposing directions from the blade 36 (as shown in FIG. 2). The overall thickness of the blade 36 measured at the edge of the opposing darts 74 is greater than the width of the terminal cavity 72. The darts 74 create an interference fit between the blade 36 and the body 30 which helps control the perpendicularity of the locking terminal 28.

In one embodiment, the locking terminal 28 is formed by stamping a thin sheet of conductive material. The tab 64 is formed during the stamping process. The projection 64 is formed during a secondary operation, such as coining or drawing. The darts 74 are formed during another secondary operation, such as upsetting.

Prior art through-hole terminals, such as press-fit pins and compliant pins, are designed to provide an interference fit between the pin and a corresponding circuit board aperture (not shown). Such prior art pins apply residual transverse loads to the circuit board after insertion, which may lead to premature cracking and failure of the board. The locking terminals 28 mechanically connect the connector assembly 20 to the circuit board 22 without applying any residual transverse loads to the board 22.

Figure 7:
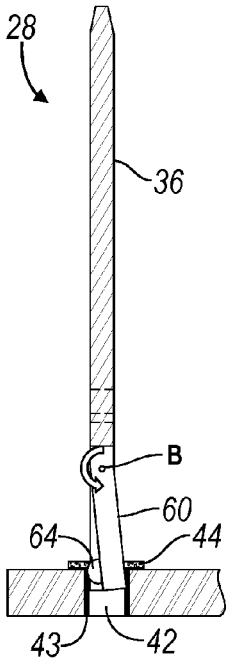
FIG. 7 is another section view of the terminal of FIG. 3, illustrated in a deformed position.
Figure 8:
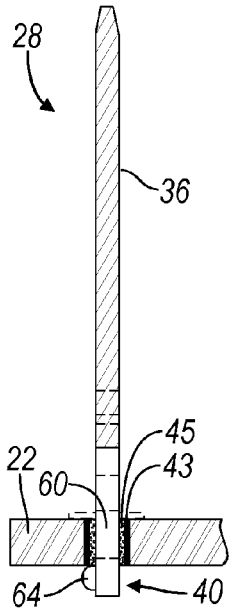
FIG. 8 is yet another section view of the terminal of FIG. 3, illustrated partially extending through the circuit board.

FIGS. 4-8 illustrate the mechanical connection of the locking terminal 28 to the circuit board 22. The locking terminal 28 translates toward the circuit board 22 and the proximal end 40 is inserted through the circuit board aperture 42. The aperture 42 is formed as a slot with a length and a width which are generally referenced by "l" and "w" in FIG. 4. The projection 64 extends from the tab 60, and the overall thickness of the blade 36 measured at the projection 64 is greater than the width of the circuit board aperture 42. The projection 64 interferes with the via 43 about the width of the aperture 42 during insertion of the tab 60 through the board 22, as shown in FIG. 7. The tab 60 elastically deforms during insertion and pivots about the connection of the tab 60 and the blade 36, which is represented by transverse axis B-B. The via 43 may also deform during insertion of the tab 60. After insertion, the tab 60 returns from the deformation and an upper surface of the projection 64 engages an underside of the circuit board 22 for retaining the tab 60 within the aperture 42, as shown in FIG. 8. This engagement of the projection 64 to the underside of the circuit board 22 results in a minimal residual longitudinal load being applied to the circuit board 22 after insertion. Other embodiments of the connector assembly 20 contemplate a projection 64 that is longitudinally spaced away from the circuit board 22 after insertion (not shown) to further reduce any residual loading of the board 22.

FIGS. 4-8 also illustrate the electrical connection of the locking terminal 28 to the circuit board 22. The proximal end 40 of the terminal 28 is inserted through the circuit board aperture 42. Then, the terminal 28 and the circuit board 22 are heated until the paste 44 becomes a liquid and flows into the aperture 42. The liquid solder cools to form the solder joint 45 between each proximal end 40 and the corresponding via 43, as shown in FIG. 8.

Figure 9:
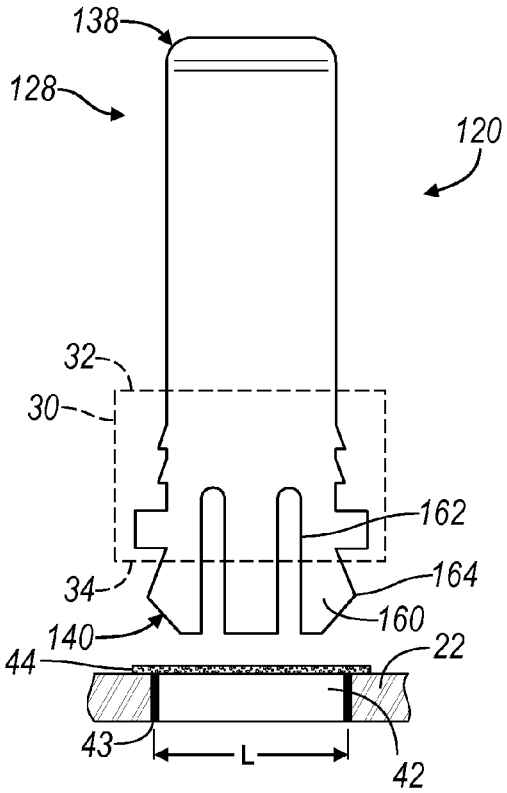
FIG. 9 is a side view of a connector assembly according to another embodiment, and illustrated above the circuit board.

With reference to FIG. 9, a connector assembly is illustrated in accordance with another embodiment and is generally referenced by numeral 120. The connector assembly 120 includes at least one locking terminal 128 for mechanically connecting the connector assembly 120 to the circuit board 22. The body 30 of the connector assembly 120 is similar to the body 30 described for previous embodiments. The locking terminal 128 differs from previous embodiments in that the terminal 128 interferes with the via 43 about the length of the circuit board aperture 42, rather than the width.

The locking terminal 128 includes a blade 136 with a distal end 138 and proximal end 140. The distal end 138 extends from the first body surface 32 and electrically connects to the in-line connector 24 (shown in FIG. 1). The proximal end 140 of each locking terminal 128 extends from the second body surface 34 and electrically connects to the circuit board 22. A pair of tabs 160 extend lengthwise towards the proximal end 140 of the blade 136. The tabs 160 are formed outside of a pair of slots 162 that project through the blade 136. The slots 162 are spaced apart from each other along a transverse width of the blade 136 and extend lengthwise from the proximal end 140 to an intermediate portion of the blade 136. A projection 164 is formed in each tab 160 and extends outward from the tab 160.

Figure 10:
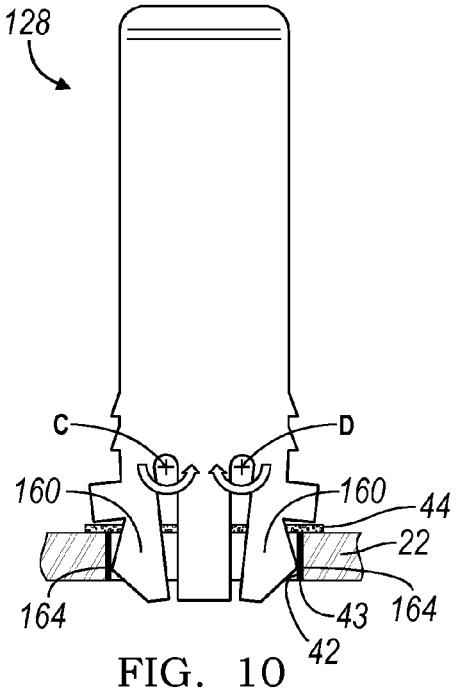
FIG. 10 is a side schematic view of the terminal of FIG. 9, illustrated in a deformed position.
Figure 11:
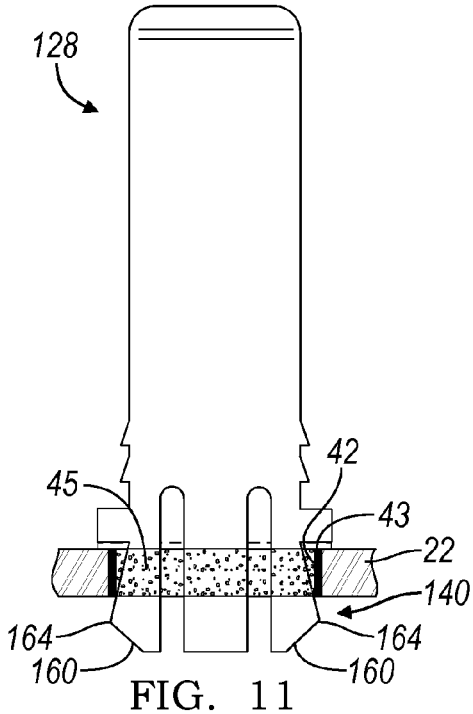
FIG. 11 is another side schematic view of the terminal of FIG. 9, illustrated partially extending through the circuit board.

FIGS. 10 and 11 illustrate the mechanical connection of the locking terminal 128 to the circuit board 22. The locking terminal 128 translates toward the circuit board 22 and the proximal end 140 is inserted through the circuit board aperture 42. The projections 164 each extend from the corresponding tab 160. The overall transverse width of the blade 136 measured at the projections 164 is greater than the length of the circuit board aperture 42. The projections 164 each interfere with the via 43 during insertion of the tabs 160 through the board 22, as shown in FIG. 10. The tabs 60 elastically deform during insertion and pivot inward about the connection of the tabs 160 and the blade 136, which is generally represented by axes C-C and D-D. After insertion the tabs 160 return from the deformation and an upper surface of each projection 164 engages an underside of the circuit board 22. The projections 164 retain the tabs 160 within the aperture 42 without applying any residual transverse loads to the circuit board 22. The engagement of the projections 164 to the underside of the circuit board 22 results in a minimal residual longitudinal load being applied to the circuit board 22 after insertion. Other embodiments of the connector assembly 120 contemplate projections 164 that are longitudinally spaced away from the circuit board 22 after insertion (not shown) to further reduce any residual loading of the board 22.

FIGS. 9-11 also illustrate the electrical connection of the locking terminal 128 to the circuit board 22. The proximal end 140 of the terminal 128 is inserted through the circuit board aperture 42. Then, the terminal 128 and the circuit board 22 are heated until the paste 44 becomes a liquid and flows into the aperture 42. The liquid solder cools to form the solder joint 45 between each proximal end 140 and the corresponding via 43, as shown in FIG. 11.

The locking terminal 128 is formed by stamping a thin sheet of conductive material, according to one embodiment. The projections 164 may be formed during the stamping process, which eliminates the additional coining or drawing operations described for other embodiments of the connector assembly 120.

While embodiments of the present invention are described above, it is not intended that these embodiments describe all possible forms of the present invention. Rather, the words used in the specification are words of description rather than limitation, and various changes may be made without departing from the spirit and scope of the present invention. Additionally, the features of various implementing embodiments may be combined to form further embodiments of the present invention.

What is claimed:

1. A terminal comprising:

an elongate blade having a distal end for electrically connecting to a mating connector and a proximal end for inserting into an aperture of a circuit board for electrically connecting to the circuit board;

at least one tab extending lengthwise from an intermediate portion of the blade for extending through the circuit board aperture; and a projection extending outward from the at least one tab such that the projection interferes with the circuit board aperture during insertion of the at least one tab therethrough for deforming the at least one tab, such that after insertion the at least one tab returns from the deformation thereby engaging the projection to the circuit board and thereby retaining the at least one tab within the aperture;

wherein the at least one tab is laterally spaced apart from the circuit board after insertion for limiting residual loads applied to the circuit board by the terminal; and wherein the at least one tab is formed by a pair of slots formed through a transverse width of the blade and spaced apart from each other, each slot extending lengthwise from the proximal end to the intermediate portion of the blade, and wherein the at least one tab is formed between the slots.

2. The terminal of claim 1 wherein the projection engages an underside of the circuit board after insertion of the at least one tab for maintaining a longitudinal position of the terminal relative to the circuit board.

3. The terminal of claim 1 wherein the blade comprises a first surface and a laterally spaced apart second surface that together define a blade thickness, and wherein the projection extends perpendicularly from the first surface for mechanically connecting the terminal to the circuit board without applying any residual lateral loads to the circuit board after insertion.

4. The terminal of claim 1 wherein the at least one tab deforms about a transverse axis formed at the connection between the at least one tab and the blade.

5. The terminal of claim 1 wherein the at least one tab is adapted for elastically deforming during insertion.

6. A connector assembly comprising:

a body; and a pair of terminals according to claim 1, wherein each terminal projects through the body.

7. The connector assembly of claim 6 wherein the body is formed in a rectangular shape with a first body surface and a second body surface that is longitudinally spaced apart from the first body surface, and wherein the distal end of each blade extends from the first body surface and the proximal end of each blade extends from the second body surface.

8. The connector assembly of claim 7 wherein the connector assembly further comprises a plurality of surface mount terminals extending through the body, each surface mount terminal having a first end extending from the first body surface for electrically connecting with the mating connector, and a leg extending from the second surface for electrically connecting to a mounting surface of the circuit board.

9. The connector assembly of claim 8 further comprising a foot formed at a proximal end of each leg, the foot being longitudinally spaced apart from the projection of the terminal at a distance that is less than a circuit board thickness for providing an interference fit between each foot and the mounting surface.

10. A terminal comprising:

an elongate blade having a distal end for electrically connecting to a mating connector and a proximal end for inserting into an aperture of a circuit board for electrically connecting to the circuit board;

at least one tab extending lengthwise from an intermediate portion of the blade for extending through the circuit board aperture; and a projection extending outward from the at least one tab such that the projection interferes with the circuit board aperture during insertion of the at least one tab therethrough for deforming the at least one tab, such that after insertion the at least one tab returns from the deformation thereby engaging the projection to the circuit board and thereby retaining the at least one tab within the aperture;

wherein the at least one tab includes a central tab laterally spaced apart from the circuit board after insertion for limiting residual loads applied to the circuit board by the terminal; and wherein the at least one tab is formed by a pair of slots formed through a transverse width of the blade and spaced apart from each other, each slot extending lengthwise from the proximal end to the intermediate portion of the blade, and wherein the at least one tab comprises two outer tabs formed outward of the slots along the width of the blade.

11. The terminal of claim 10 wherein the projection comprises two projections each extending outward from one of the outer tabs for engaging the circuit board aperture and wherein each outer tab is configured for pivoting about a lateral axis formed at an apex of an adjacent slot.

12. The terminal of claim 10 wherein the projection engages an underside of the circuit board after insertion of the at least one tab for maintaining a longitudinal position of the terminal relative to the circuit board.

13. The terminal of claim 10 wherein the outer tab are adapted for elastically deforming during insertion.

14. A connector assembly comprising:

a body; and a pair of terminals according to claim 10, wherein each terminal projects through the body.

15. The connector assembly of claim 14 wherein the body is formed in a rectangular shape with a first body surface and a second body surface that is longitudinally spaced apart from the first body surface, and wherein the distal end of each blade extends from the first body surface and the proximal end of each blade extends from the second body surface.

16. The connector assembly of claim 15 wherein the connector assembly further comprises a plurality of surface mount terminals extending through the body, each surface mount terminal having a first end extending from the first body surface for electrically connecting with the mating connector, and a leg extending from the second surface for electrically connecting to a mounting surface of the circuit board.

17. The connector assembly of claim further comprising a foot formed at a proximal end of each leg, the foot being longitudinally spaced apart from the projection of the terminal at a distance that is less than a circuit board thickness for providing an interference fit between each foot and the mounting surface.

18. A connector assembly comprising:

a body extending along a lateral length with a longitudinal height defined by a first body surface and an opposing second body surface;

a locking terminal comprising:

an elongate blade having a distal end for electrically connecting to a mating connector and a proximal end for inserting into an aperture of an electronic component for electrically connecting to the electronic component, at least one tab extending lengthwise from an intermediate portion of the proximal end of the blade for extending through the electronic component aperture, and a projection extending outward from the at least one tab such that the projection interferes with the electronic component aperture during insertion of the at least one tab therethrough for deforming the at least one tab, such that after insertion the at least one tab returns from the deformation and is laterally spaced from the electronic component thereby retaining the at least one tab within the aperture without applying any residual transverse loads to the electronic component; and a surface mount terminal projecting through the body, the surface mount terminal having a leg extending from the second surface for electrically connecting to a mounting surface of the electronic component.

19. The connector assembly of claim 18 further comprising a post extending from the second surface of the body for resting upon the electronic component.

* * * * *

UNITED STATES PATENT AND TRADEMARK OFFICE

CERTIFICATE OF CORRECTION

PATENT NO. : 8,480,412 B2
APPLICATION NO. : 13/165399
DATED : July 9, 2013
INVENTOR(S) : Thomas D. Belanger, Jr.

It is certified that error appears in the above-identified patent and that said Letters Patent is hereby corrected as shown below:

In the Claims

Column 8, Line 10, Claim 17:

After "the connector assembly of claim"
Insert -- 16 --.

Signed and Sealed this
Eighteenth Day of March, 2014

Michelle K. Lee

Michelle K. Lee
*Deputy Director of the United States Patent and Trademark Office*